United States Patent [19]

Tasaki et al.

[11] Patent Number: 4,908,079

[45] Date of Patent: Mar. 13, 1990

[54] WATER IN OIL TYPE EMULSION EXPLOSIVE

[75] Inventors: Yoji Tasaki; Akihiro Tanaka; Koichi Kurokawa; Katsuhide Hattori; Motoyuki Amano, all of Chita, Japan

[73] Assignee: Nippon Oil and Fats Co., Ltd., Tokyo, Japan

[21] Appl. No.: 377,813

[22] Filed: Jul. 6, 1989

Related U.S. Application Data

[63] Continuation of Ser. No. 270,651, Nov. 14, 1988, abandoned.

[30] Foreign Application Priority Data

Nov. 13, 1987 [JP] Japan ..... 62-285608
Aug. 25, 1988 [JP] Japan ..... 63-209523

[51] Int. Cl.[4] ..... C06B 45/00

[52] U.S. Cl. ..... 149/2; 149/21; 149/43; 149/44; 149/46; 149/60; 149/83; 149/92.

[58] Field of Search ..... 149/2, 21, 43, 44, 46, 149/60, 83, 92

[56] References Cited

U.S. PATENT DOCUMENTS 4,409,044 10/1983 Bhattachasyya et al. ..... 149/2
4,470,855 9/1984 Bampfield ..... 149/2
4,708,753 11/1987 Forsberg ..... 149/2
4,732,626 3/1988 Edamura et al. ..... 149/2

FOREIGN PATENT DOCUMENTS 0044671 1/1982 European Pat. Off. .
0142271 5/1985 European Pat. Off. .
1262973 2/1972 United Kingdom .

OTHER PUBLICATIONS

Chemical Abstracts, vol. 102, No. 4, Jan. 1985, p. 175, No. 27602j, Columbus, Ohio, U.S.; & JP-A-59 162 194 (Nippon Oils and Fats Co., Ltd.) 9/13/84.
Chemical Abstracts, vol. 98, No. 14, Apr. 1983, p. 149, No. 109962q, Columbus, Ohio, U.S.; & JP-A-57 149 893 (Asahi Chemical Industry Co., Ltd.) 9/16/82.
Kirk-Othmer: "Encyclopedia of Chemical Technology", 1983, Editor Board H. F. Mark et al., 3rd Edition, vol. 24, pp. 477-478, Wiley, New York, U.S.
H. F. Mark et al.: "Encyclopedia of Polymer Science and Technology, Plastics, Resins, Rubbers, Fibers", 1971, vol. 14, p. 769, Interscience, New York, U.S.

*Primary Examiner*—Stephen J. Lechert, Jr.
*Attorney, Agent, or Firm*—Arnold, White & Durkee

[57] ABSTRACT

An excellent water in oil type emulsion explosive having both of a superior handling property and a good aging initiating sensitivity at low temperatures and at small calibers, is provided by using a specific low molecular weight polyethylene as the carbonaceous fuel in the emulsion explosive.

16 Claims, No Drawings

WATER IN OIL TYPE EMULSION EXPLOSIVE

This is a continuation of application Ser. No. 270,651, filed Nov. 14, 1988, now abandoned.

BACKGROUND OF THE INVENTION

1. Field of the Invention

The present invention relates to a water in oil type (to be referred to as "W/O type", hereinafter) emulsion explosive.

2. Related Art Statement

A W/O type emulsion explosive was published for the first time by U.S. Pat. No. 3,161,551. Afterwards, various W/O type emulsion explosives have been proposed depending on the use purposes.

Heretofore proposed W/O type emulsion explosives are basically composed of a continuous phase of a carbonaceous fuel, a dispersive phase of an aqueous solution of an inorganic oxidate, an emulsifier, and a foam retainer.

A W/O type emulsion explosive having an initiating sensitivity of improved aging stability at small calibers and low temperatures by using a specific emulsifier such as a mixed emulsifier consisting of a specific mixing proportions of sorbide fatty acid ester, sorbitan fatty acid ester and sorbitol fatty acid ester, is known from Japanese Patent Application Laid-open No. 59-207,889. The carbonaceous fuel practically used therein is a petroleum wax such as microcrystalline wax or a hydrocarbon oil obtained by purifying a lubricant fraction such as fluid paraffin.

A W/O type emulsion explosive of an improved aging stability by using in combination a specific emulsifier such as an emulsifier having a hydrophobic group consisting of a long chain unsaturated fatty acid, for example, sorbitan monooleate, and a petroleum wax such as microcrystalline wax containing 30% or more of urea non-added component or paraffin wax, etc., is known from Japanese Patent Application Publication No. 60-8,988.

A W/O type emulsion explosive having a sympathetic detonation sensitivity of improved aging stability by using a carbonaceous fuel not containing an oil fraction and containing a polymer selected from epoxy resin, unsaturated polyester resin, polybutene, isobutyrene, petroleum resin, butadiene resin, is proposed by Japanese Patent Application Laid-open No. 61-40,892. The petroleum resin used therein is a $C_5$ series or $C_9$ series petroleum resin derived by polymerizing the fractions obtained in the naphtha-cracking process, and preferably has a molecular weight of 1,000–1,400.

A W/O type emulsion explosive of the same purpose using a polymer selected from a polymer or a copolymer of α-olefin, a polymer or a copolymer of pentadiene, and an alicyclic hydrocarbon resin, as the carbonaceous fuel, is also proposed by Japanese Patent Application Laid-open No. 61-40,893. The polymer of α-olefin used therein is a polymer prepared mainly from α-olefin having 6–14 carbon atoms and a general formula of $CH_2{=}CH{-}R$ wherein R represents an alkyl group, which polymer preferably has a molecular weight of 300–100,000, more preferably has a molecular weight of 300–3,000 and a liquid state at ambient temperature. In its preparation examples, a polymer of α-olefin, which has a molecular weight of about 7,000 (Trade name "Riboloop 70", pour point −55° C., produced by Lion Yushi K.K.), is only shown as suitable. The polymer is an oligomer of α-olefin, which is liquid at ambient temperature.

A W/O type emulsion explosive of improved aging stability using simultaneously an oil content such as gear oil, a polymer selected from a polyethylene wax of a number average molecular weight of 500–5,000, a polypropylene of an average molecular weight of not exceeding 5,000, and an atactic polypropylene of an average molecular weight of not exceeding 15,000, as the carbonaceous fuel, is also proposed by Japanese Patent Application Laid-open No. 57-149,893. In its examples, polyethylene wax is shown to have number average molecular weights of 300, 500, 2,000, 5,000, and 8,000, and no mention is made about melting point, density and terminal group, nor about trade names of the used polyethylene waxes.

Meanwhile, a W/O type emulsion explosive, for a purpose of hardening the emulsion, using a specific emulsifier, i.e., specific amounts of fatty acid and fatty acid soap, as well as a mixture of a specific proportion of sorbide fatty acid ester, sorbitan fatty acid ester and sorbitol fatty acid ester, is known from Japanese Patent Application Laid-open No. 62-162,685. In its examples, practically used carbonaceous fuel is a fluid paraffin or a petroleum wax, such as microcrystalline wax or paraffin wax, etc.

The above prior W/O type emulsion explosive wherein a specific emulsifier or a combination of a specific emulsifier and a specific petroleum wax is used has a drawback in that the explosive does not harden sufficiently, though the aging stability thereof is improved.

The above prior W/O type emulsion explosive wherein a specific polymer is used as a carbonaceous fuel has drawbacks in that it has frequently a high viscosity and a high adhesive power to result in difficulty in the production process, and that it does not harden sufficiently, though the shelf stability thereof is improved.

The above prior W/O type emulsion explosive wherein an oligomer of α-olefin which is liquid state at ambient temperature is used as a carbonaceous fuel has drawbacks in that it has a high adhesive power and does not harden sufficiently, though aging stability of the sympathetic detonation sensitivity is improved.

The prior W/O type emulsion explosive wherein polyethylene wax is co-used with the oil content has drawbacks in that the characteristic property thereof is not improved, if the polyethylene wax has a number average molecular weight of less than 350, and that the aging stability of the initiating sensitivity is deteriorated. In addition, even when a polyethylene wax of a number average molecular weight of 350–1,000 is co-used as the carbonaceous fuel in the production process of the W/O type emulsion explosive, the production has a difficulty depending on the terminal group in that the emulsification is hardly performed when the terminal group of the wax is a carboxylic group.

The prior W/O type emulsion explosive wherein a specific amount of a fatty acid or fatty acid soap is used and a mixture of a specific proportion of emulsifiers is used has drawbacks n that an emulsion explosive of constantly stable properties is hardly obtained, and that the characteristic properties thereof are restricted and still insufficient.

A prior W/O type emulsion explosive wherein an oil of a high melting point or high softening point as the carbonaceous fuel is reciped and co-used with an emulsifier can produce an emulsifier which is hard to some extent by reciping large amounts of the oil and the emulsifier and adjusting the reciping proportion thereof. However, it has a drawback i that the aging stability of the initiating sensitivity of the emulsion explosive is deteriorated due to the increase of the amounts of the emulsifier and the oil of a high viscosity.

If the W/O type emulsion explosive is soft in its characteristic property, the product emulsion explosives, particularly those of small calibers, are liable to deform during the transportation, and difficult in handling in that they are difficult to charge in small bores due to their deformation in charging. Such deformation is a cause of insufficient effect of detonation or a cause of non-detonation.

A W/O type emulsion explosive is requested to have a good aging stability, because it is often used after about 6–12 months at the longest from the production thereof.

However, a W/O type emulsion explosive having sufficiently satisfiable aging stability and shape-holding hard property has not yet been proposed, so that such emulsion explosive has been earnestly desired.

SUMMARY OF THE INVENTION

Therefore, an object of the present invention is to provide a W/O type emulsion explosive having hard property and easy handling property as well as a good aging stability of initiating sensitivity at small calibers such as 25 mmϕ and low temperatures.

The inventors made many studies and researches for many years on various waxes and polymers as the carbonaceous fuel in the W/O type emulsion explosive about productivity and aging stability of the emulsion explosive, leading to the present invention to find out that the above desire can be achieved by using a specific low molecular weight polyethylene as the carbonaceous fuel.

The present invention is a W/O type emulsion explosive containing a continuous phase of a carbonaceous fuel, a dispersive phase of an aqueous solution of an inorganic oxidate, an emulsifier, and a foam retainer, wherein the carbonaceous fuel is a low molecular weight polyethylene of 20–80 carbon atoms not having a polar group at its terminal end, and having a melting point or softening point of 40°–120° C., a number average molecular weight of 350–1,000, and a density of 0.90–0.96 cc/g.

In another aspect of the present invention, the present invention is a W/O type emulsion explosive, wherein the carbonaceous fuel comprises 5 wt % or more of the low molecular weight polyethylene, and 95 wt % or less of at least one waxes selected from the group consisting of mineral, animal, vegetable, petroleum and synthetic waxes of a melting point of 40° C. or more and containing 10% or more of isoparaffin.

Thus, the carbonaceous fuel according to the present invention is the specific low molecular weight polyethylene as mentioned above (to be abbreviated as "present polyethylene", hereinafter), or the carbonaceous fuel consists of the present polyethylene and the specific natural and/or synthetic wax as mentioned above.

The present polyethylene is solid at ambient temperature, and is entirely different from the heretofore known oligomer essentially consisting of polymers of α-olefin having a general formula of $CH_2{=}CH{-}R$ wherein R represents an alkyl group.

In the present invention, if the melting point or softening point of the present polyethylene exceeds 120° C., or if the number average molecular weight of the present polyethylene exceeds 1,000 corresponding to carbon atoms exceeding 80, or if the density of the present polyethylene exceeds 0.96 g/cc, the resultant W/O type emulsion explosive is high in viscosity and hard in property, although the productivity is bad and the aging stability of initiating sensitivity is bad.

Meanwhile, if the melting point or softening point of the present polyethylene is less than 40° C., or if the number average molecular weight is less than 350 corresponding to the carbon atoms receding 20, or if the density of the present polyethylene is less than 0.90, the productivity is good due to the low viscosity of the present polyethylene. However, the resultant emulsion explosive is soft in property, weak in physical strength of the continuous phase, and bad in aging stability of initiating sensitivity, particularly at small caliber of 25 mmϕ at low temperatures.

Thus, considering the productivity and hardness of the obtained emulsion explosive, the melting point or softening point of the present polyethylene is preferably 60°–100° C.

Even when the present polyethylene satisfies the above described conditions, if the present polyethylene has a polar group, e.g., a carboxylic group etc., at its terminal end, the emulsification step of the production process is difficult to perform, and the aimed W/O type emulsion explosive of excellent aging stability can not be obtained.

Measuring methods of melting point, softening point, number average molecular weight and density of the present polyester are those usually effected for polyethylene.

The present polyester is exemplified in the following Table 1 which, however, should not be construed by any means as limitations thereof to those commercially sold products.

TABLE 1

| No. | Trade Name | Sold by | m.p. or s.p. (°C.) | Number Average M.W. | Carbon number | Density (g/cc) |
|---|---|---|---|---|---|---|
| 1 | Diarene 30 | Mitsubishi Kasei Kogyo | 79 | 400 | 29 | 0.96 |
| 2 | Hiwax 110 | Mitsui Petrochem. Ind. | 100 | 1000 | 71 | 0.90 |
| 3 | Polywax 500 | Petrolite | 86 | 500 | 36 | 0.93 |
| 4 | Polywax 655 | Petrolite | 102 | 700 | 50 | 0.96 |
| 5 | Polywax 1000 | Petrolite | 113 | 1000 | 71 | 0.96 |

Note:
s.p. = abbreviation of softening point

Each exemplified polyester has no polar group at its terminal end.

In case when the specific wax is co-used with the present polyethylene, if the wax has a low m.p. than 40° C., the viscosity during the production of the W/O type emulsion explosive is low, so that the productivity of the emulsion explosive is good, however, the emulsion explosive is soft in property and bad in aging stability, and the physical strength is weak in the continuous phase.

In such case of co-using, if the content of isoparaffin in the wax is less than 10 wt %, the content of the main chain component expressed by normal paraffin is large, so that the wax has high crystallization degree and the emulsion explosive is hard, however, the wax has weak bondage to the emulsifier, the continuous phase of the carbonaceous fuel is weak in mechanical strength, and the aging stability of the emulsion explosive is bad.

The wax used in the present invention (to be abbreviated as "present wax", hereinafter) is exemplified in Table 2 below on each of mineral, animal, vegetable, petroleum, and synthetic waxes, which, however, should not be construed by any means as limitations thereof.

TABLE 2

| No. | Type | Name | Sold by | m.p. (°C.) | Content of isoparaffin (wt %) |
|---|---|---|---|---|---|
| 6 | Mineral | Serecine Wax 110 | Kato Yoko | 63 | 80 |
| 7 | Animal | Bee Wax Carbona Wax | Kato Yoko | 67 | 20 |
| 8 | Vegetable | Princ Yellow | Kato Yoko | 83 | 15 |
| 9 | Petroleum | Micro wax 160 | Mobil | 70 | 80 |
| 10 | Petroleum | Wacrex 602 | Mobil | 78 | 72 |
| 11 | Petroleum | Hi-Mic 2045 | Nihon Seiro | 60 | 78 |
| 12 | Synthetic | Salsol Wax HI | Kato Yoko | 108 | 10 |

The present polyethylene is used alone or in admixture of at least two. The present wax is used also alone or in admixture of at least two.

Reciping ratio of the present wax to the present polyethylene is usually 95% (weight basis, hereinafter the same) or less, preferably 80% or less.

If the reciping ratio exceeds 95%, the resultant emulsion explosive is soft in property.

The reciped amount of the carbonaceous fuel containing the present polyethylene optionally with 95% or less of mineral, petroleum or synthetic wax in the emulsion explosive is usually 1–10%, preferably 2–5%.

If the amount of the carbonaceous fuel is less than 1%, the initiating sensitivity of the emulsion explosive at small calibers and low temperatures is bad and the emulsion explosive is soft in property. While, if it exceeds 10%, the oxygen balance in the emulsion explosive is bad and the explosion property and the post gas are bad.

The aqueous solution of the inorganic oxidate or oxidative acid salt according to the present invention consists essentially of ammonium nitrate which has been heretofore known, and optional other inorganic oxidate. Other examples of inorganic oxidate are nitrates of alkali metal and alkaline earth metal.

In addition, perchlorates or chlorates of alkali metal or alkaline earth metal; water-soluble amine nitrates such as monomethylamine nitrate, monoethylamine nitrate, hydrazine nitrate, dimethylamine dinitrate, ethylenediamine dinitrate, etc.; water soluble alkanol amine nitrates such as methanolamine nitrate, ethanolamine nitrate, etc.; or water soluble ethyleneglycol mononitrate, can be used as auxiliary sensitizers.

Particularly preferable auxiliary sensitizer is hydrazine nitrate which has a large effect of improving the dissolution of the inorganic oxidates.

By using an auxiliary sensitizer, the reliability of detonation of the emulsion explosive is improved as well as the initiating sensitivity at low temperatures.

Reciping amount of ammonium nitrate is usually 36–95% of the total amount of the inorganic oxidate. If necessary, ammonium nitrate can also contain other inorganic oxidate etc. at a content of 40% or less of the total amount of the inorganic oxidates including ammonium nitrate.

If an auxiliary sensitizer is used, the reciped amount thereof is usually 40% or less, preferably 30% or less, particularly 20% or less, of the total amount of the inorganic oxidate(?). If it exceeds 40%, the risk of danger in handling the emulsion explosive increases, sometimes.

Usually, the amount of water used in the aqueous solution of the inorganic oxidate is 5–25%.

The emulsifier according to the present invention includes all emulsifiers that are hitherto known for forming W/O type emulsion explosives. For example, use is made of sorbitan fatty acid ester, glycerin fatty acid ester, polyhydroxyalkylenesorbitol fatty acid ester, oxazolin derivatives, imidazolin derivatives, phosphates or phosphoric acid esters, alkali metal salts or alkaline earth metal salts of fatty acids, primary, secondary or tertiary amines or their nitrates or acetates. These are used alone or in admixture of at least two.

Reciping amount of the emulsifier is usually 0.1–7%, preferably 0.5–4%, of the emulsion explosive.

The W/O type emulsion explosive of the present invention is adjusted to an apparent specific density of 0.80–1.35, preferably 1.00–1.20, by means of the foam retainer.

The foam retainer according to the present invention is heretofore known micro hollow spheres, micro foams or aggregates of foams which form primary particles, etc., as described in Japanese Patent Application Laid-open No. 60-90,887.

As the micro hollow spheres, use is made of, for example, inorganic micro hollow spheres such as obtained from glass, sirasu (Japanese volcanic ash), silicon sand, sodium silicate or the like; carbonaceous micro hollow spheres such as obtained from coal or the like; synthetic micro hollow spheres such as obtained from polyvinylidene chloride or the like; or surface-treated ones thereof. The micro hollow spheres are usually used in an amount of 0.01–10%.

As the micro foams, use is made of, for example, micro foams obtained by incorporating and foaming a chemical foaming agent, micro foams obtained by mechanically blowing air or other gas during or after the step of producing a W/O type emulsion explosive, or the like. The chemical foaming agent used herein is, for example, inorganic chemical foaming agents such as alkali metal hydrogen boride, a combination of sodium nitrite and urea, or the like; organic chemical foaming agents such as N,N'-dinitrosopentamethylenetetramine, azobisisobutylonitrile, etc.; or the like. The chemical foaming agent is usually used in an amount of 0.01–2%.

As the aggregates of foams, use is made of those aggregates of foams having a cellular or spongy structure obtained by incorporating and foaming a foaming agent or foamer selected from inorganic foamers, organic foamers, and hydrocarbonic defoamers of low boiling point, in a thermoplastic resin such as polystyrene, ABS, polyethylene, polypropylene, polyvinylchloride, cellulose acetate, or acrylic resin, a natural or synthetic rubber; or a copolymer or modified one thereof. The aggregate of foams is usually used in an amount of 0.05–15%.

These micro hollow spheres, micro foams or aggregates of foams are used alone or in admixture of at least two.

If used the aggregates of foams as the foam retainer in the present invention, an emulsion explosive having an explosion property exactly as designed and a superior aging stability of the initiating sensitivity can be obtained.

If the micro hollow spheres and the aggregates of foams are co-used, the problem of the destruction of the micro hollow spheres during the production of the emulsion explosive can be obviated.

In addition to the above-described components, a heretofore known emulsion stabilizer such as a powder of a size of 1 μm or less insoluble in water and oil can be added in the emulsion explosive, as described in Japanese Patent Application Publication No. 58-15,467. A water-soluble phosphate (Japanese Patent Application Laid-open No. 59-78,995) or a chelating agent can also be added to the emulsion explosive depending on the above-described components.

Particularly advantageous for preventing decomposition etc. of hydrazine nitrate, if a chelating agent such as ethylenediaminetetraacetic acid sodium salt is used, when hydrazine nitrate or the like is used as the auxiliary sensitizer.

If the emulsion explosive is to be used in coal mines, a heretofore known halide such as sodium chloride can be added in the emulsion explosive.

The W/O type emulsion explosive is produced by the following method. Briefly describing, the method comprises the steps of preparing a solution of an inorganic oxidate, adding and mixing a specific carbonaceous fuel and an emulsifier to the aqueous solution, emulsifying the aqueous solution under agitation, and adding a foam retainer to the aqueous solution. Preferably, the preparation, mixing and emulsification of the aqueous solution are effected under heating, e.g., at 90° C.

Thus obtained W/O type emulsion explosive of the present invention has a hardness of 10–20 mm in terms of a penetration depth. The expression "penetration depth" used herein means a depth of penetration of an iron cone of a weight of 133 g and having a degree of 30° at the conical portion in the emulsion explosive when dropped the iron cone from a height of 45 mm.

The W/O type emulsion explosive of the present invention containing the specific carbonaceous fuel has, as compared to those not containing the specific carbonaceous fuel, an advantageous effect of enhancing the hardness thereof without harming the aging stability thereof at small calibers such as 25 mmϕ and at low temperatures, so that the charging thereof in the small bores at the time of blasting is facilitated resulting in improvement of the handling property thereof.

If the specific carbonaceous fuel according to the present invention is used in the production process, the produced W/O type emulsion explosive has a low viscosity as well as a low adhesive property, so that it has a high productivity. Moreover, as compared with those W/O type emulsion explosives wherein specific emulsifiers are mixed in a specific mixing proportion for improving their property, the W/O type emulsion explosive of the present invention has an advantageous effect of attaining a constant quality of product in that it uses a single emulsifier always.

DESCRIPTION OF THE PREFERRED EMBODIMENTS

Hereinafter, the present invention will be explained in more detail by referring to examples which should not be construed by any means as limitations of the present invention.

In the examples, all parts are represented by weight basis.

EXAMPLE 1

A W/O type emulsion explosive having the composition as shown in the following Table 3 is produced in the following way.

75.5 parts of ammonium nitrate, and 5.0 parts of sodium nitrate, are added to 12.2 parts of water, and heated to 90° C. to be completely dissolved to obtain an aqueous solution of inorganic oxidates. Meanwhile, 3.0 parts of polyethylene of a low molecular weight (Trade name "Diarene 30", produced by Mitsubishi Kasei Kogyo) as the carbonaceous fuel according to the present invention, and 1.7 part of sorbitan monooleate as the emulsifier, are melted and mixed to obtain a mixture of combustible matters. The mixture is slowly added with 92.7 parts of the above aqueous solution of inorganic oxidates, and emulsified while heating at 90° C. and agitating at 650 rpm. After the emulsification, an agitation at 1,800 rpm is further effected for 3 minutes to obtain 97.4 parts of a W/O type emulsion explosive. 97.4 parts of the W/O type emulsion explosive, and 2.6 parts of glass micro hollow spheres (Trade name "Glass micro hollow sphere Q-cel #500, produced by The P.Q.Co.), are mixed and kneaded. Each 100 g of the kneaded mixture is weighed out, shaped to a cylinder of a diameter of 25 mm, and wrapped by a viscose paper to obtain a W/O type emulsion explosive.

Characteristic properties of the emulsion explosive are tested on the following items.

(a) Apparent specific density or tentative specific density after 1 day of the production.

(b) Aging stability of ignition sensitivity (abridged as "ASIS" in Tables 3 and 4 below), wherein the wrapped explosive is subjected to a storage test under forced deterioration consisting of repetition of a temperature cycle of holding the wrapped explosive at −40° C. for 2 hours and then at +30° C. for 2 hours, and then to an ignition test at −15° C. using a No. 6 detonator, in order to determine the number of the temperature cycles that can ignite the explosive fully.

(c) Ignition sensitivity at low temperatures (abridged as "ISLT" in Tables 3 and 4 below), wherein the wrapped explosive is held at 50° C. for 72 hours, then left under storage at an ambient temperature (0°–30° C.) for 1 year, and ignited at a low temperature, in order to determine the lowest value of such low temperature that can ignite the explosive, and (d) Measurement of hardness in terms of penetration depth (mm) wherein the penetration depth is measured as mentioned above.

The results are shown also in Table 3.

EXAMPLES 2–10

The procedure of Example 1 is repeated using the reciped compositions as described in the columns of Examples 2–10 in Table 3 to obtain respective W/O type emulsion explosives. Each emulsion explosive is tested on the same items as in Example 1. The results are shown in Table 3.

COMPARATIVE EXAMPLES 1–8

The procedure of Example 1 is repeated using the reciped compositions as described in the columns of Comparative Examples 1–8 in Table 3 to obtain respective W/O type emulsion explosive. Each emulsion explosive is tested on the same items as in Example 1. The results are shown in Table 3.

In Table 3, the circled numbers represent the following carbonaceous fuels

(10) Waxrex 602: Microcrystalline wax, m.p. 81° C., produced by Mobile Petroleum Co.

(11) Hi-Mic 2045: Microcrystalline wax, m.p. 60° C., produced by Nippon Seiro K.K.

(13) Diarene 208: Low molecular weight polyethylene, m.p. or softening point 38° C., number average molecular weight 318 corresponding to carbon atom numbers of 23, density 0.96 g/cc, produced by Mitsubishi Kasei Kogyo K.K.

(14) Hiwax 200: Low molecular weight polyethylene, m.p. or softening point 113° C., number average molecular weight 2,000 corresponding to carbon numbers of 143, density 0.97 g/cc, produced by Mitsui Petrochemical K.K.

(15) Polywax 2000: Low molecular weight polyethylene, m.p. or softening point 125° C., number average molecular weight 2,000 corresponding to carbon atom numbers of 143, density 0.96 g/cc, produced by Petrolight Co.

(16) Polybis 10N: Polybutene, number average molecular weight 1,000, produced by Nippon Oil and Fats Co., Ltd.

(17) Evaflex 210: Vinylacetate copolymer containing 40% of vinyl acetate, softening point 85° C., produced by Mitsui Polychemical K.K.

(18) Ripolub 70: Oligomer of α-olefin, number average molecular weight 700, produced by Lion Yushi K.K.

In Table 3, the circled numbers of the foam retainers represent the followings.

(20) GMB (Q-cel #500): Glass micro hollow spheres, produced by the P.Q. Co.

(21) SMB (SPW-7): Sirasu micro hollow spheres, produced by Kushiro Sekitan Kanryu K.K.

(22) RMB (Expancel DE): Polyvinylidenechloride series resin, produced by Kemanorde Plastic K.K.

(23) Prefoamed particles of foamed styrol: prefoamed particles of beads of a size of 0.2 mm or less among the foamed styrol beads produced by Mitsubishi Yuka Badishe K.K. (bulk specific density 0.3, average particle diameter 0.6 mm)

From the comparisons of the values of Examples 1–10 and the values of Comparative Examples 1–8 as shown in Table 3, it is seen clearly that the W/O type emulsion explosives of Examples 1–10 containing the specific low molecular weight polyethylenes as the carbonaceous fuel are hard in property without damaging the aging stability, as compared with those not containing or using such specific carbonaceous fuel.

TABLE 3(a)

(wt %)

| | | Example | | | | | | | | | |
|---|---|---|---|---|---|---|---|---|---|---|---|
| | | 1 | 2 | 3 | 4 | 5 | 6 | 7 | 8 | 9 | 10 |
| Aqueous solution of inorganic oxidate | Ammonium nitrate | 75.5 | 73.1 | 75.3 | 72.0 | 65.1 | | 47.1 | 67.0 | 71.0 | 52.3 |
| | Sodium nitrate | 5.0 | 5.6 | 5.2 | | 4.2 | 38.3 | 1.2 | 9.2 | 9.2 | 4.2 |
| | Calcium nitrate | | | | | 1.0 | 3.7 | | | | |
| | Water | 12.2 | 11.2 | 9.5 | 12.0 | 10.2 | 3.0 | 12.0 | 9.1 | 9.1 | 12.5 |
| Carbonaceous fuel | (1) Diarene 30 | 3.0 | | | | | | | 3.2 | | |
| | (2) Hiwax 110 | | 3.2 | | | | | | | 2.0 | |
| | (3) Polywax 500 | | | 1.2 | | | | | | | 1.0 |
| | (4) Polywax 655 | | | | 2.9 | | 1.0 | | | | |
| | (5) Polywax 1000 | | | | | 1.0 | | 3.0 | | | |
| | (10) Waxrex 602 | | | | | 2.4 | 0.5 | | | | |
| | (11) Hi-Mic2045 | | | 2.2 | | | | | | 1.2 | |
| Emulsifier | Sorbitanmonooleate | 1.7 | 1.6 | 1.2 | 1.5 | 1.0 | | | 1.6 | | 2.0 |
| | Monoglyceride stearate | | | 0.5 | | 0.7 | 1.5 | 1.5 | | 1.6 | |
| Foam retainer | (20) GMB (Q-cel #500) | 2.6 | | | 4.0 | 4.0 | 3.0 | | | | 5.0 |
| | (21) SMB (SPW-7) | | | | | | 2.0 | 3.0 | 4.85 | | |
| | (22) RMB (Exparcel DE) | | | | | | | 0.2 | | | |
| | (23) Foamed styrol | | 0.9 | 1.15 | | 0.3 | | | | 0.9 | |

TABLE 3(b)

(wt %)

| | | Example | | | | | | | | | |
|---|---|---|---|---|---|---|---|---|---|---|---|
| | | 1 | 2 | 3 | 4 | 5 | 6 | 7 | 8 | 9 | 10 |
| Auxiliary sensitizer | Hydrazine nitrate | | | 2.0 | 2.2 | | 40.0 | | | | 21.0 |
| | Monomethylamine nitrate | | 4.0 | 1.0 | 4.0 | 5.0 | | | 3.0 | | |
| | Ethylenediamine nitrate | | | | | | 5.0 | 30.0 | | | |
| | Ethanolamine nitrate | | | | | 5.0 | | | | | |
| | Sodium chlorate | | | | | | | | | 4.0 | |
| | Aluminum powder | | | | | | | | | 1.0 | |
| Emulsion stabilizer | Zinc stearate | | 0.3 | 0.7 | 0.4 | | | | | | |
| Chelating agent | Tartaric acid | | 0.1 | | | | 2.0 | | 0.05 | | |
| | Ethylenediaminetetra-acetic acid sodium salt | | | 0.05 | 0.1 | | | 1.0 | | | |

TABLE 3(b)-continued (wt %)

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| | Nitrilotriacetic acid | | | | | 0.1 | 0.05 | | 1.0 | | | 1.0 |
| | Triethanolamine | | | | | | 0.05 | | | | | 1.0 |
| Antipyretic anti-inflammator | Sodium chloride | | | | | 0.8 | | | | | | |
| Test results | (a) | Apparent specific density (g/cc) | 1.12 | 1.10 | 1.07 | 1.12 | 1.09 | 1.14 | 1.10 | 1.10 | 1.09 | 1.09 |
| | (b) | ASIS cycle (number) | 9 | 11 | 14 | 11 | 12 | 10 | 14 | 9 | 12 | 10 |
| | (c) | ISLT (after 12 months, °C.) | −20 | −25 | −25 | −25 | −20 | −20 | −15 | −20 | −20 | −25 |
| | (d) | Hardness by penetration (mm) | 11 | 15 | 17 | 12 | 15 | 11 | 13 | 11 | 16 | 12 |

TABLE 3(c)

(wt %)

| | | Comparative Example | | | | | | | |
|---|---|---|---|---|---|---|---|---|---|
| | | 1 | 2 | 3 | 4 | 5 | 6 | 7 | 8 |
| Aqueous solution of inorganic oxidate | Ammonium nitrate | 75.5 | 73.1 | 75.3 | 72.0 | 65.1 | | 69.0 | 71.0 |
| | Sodium nitrate | 5.0 | 5.6 | 5.2 | | 4.2 | 38.7 | 9.2 | 9.2 |
| | Calcium nitrate | | | | | 1.0 | 3.7 | | |
| | Water | 12.2 | 11.2 | 9.5 | 12.0 | 10.2 | 3.0 | 9.1 | 9.1 |
| Carbonaceous fuel | (13) Diarene 208 | 3.0 | | | | | | | |
| | (14) Hiwax 200 | | 2.0 | | | | | | |
| | (15) Polywax 2000 | | | 3.4 | | | | | |
| | (16) Polybis 10N | | | | 2.9 | | | | |
| | (17) Evaflex 210 | | | | | 2.0 | | | |
| | (18) Ripolub 70 | | | | | | 1.5 | | |
| | (10) Waxrex 602 | | 1.2 | | | | | 3.2 | |
| | (11) Hi-Mic 2045 | | | | | 1.4 | | | 3.2 |
| Emulsifier | Sorbitanmonooleate | 1.7 | 1.6 | 1.2 | 1.5 | 1.0 | | 1.6 | |
| | Monoglyceride stearate | | | 0.5 | | 0.3 | 1.5 | | 1.6 |
| Foam retainer | (20) GMB (Q-cel #500) | 2.0 | | | 4.0 | 4.0 | 3.0 | | |
| | (21) SMB (SPW-7) | | | | | | 1.6 | 4.85 | |
| | (22) RMB (Exparcel DE) | 0.6 | | | | | | | |
| | (23) Foamed styrol | | 0.9 | 1.15 | | 0.3 | | | 0.9 |

TABLE 3(d)

(wt %)

| | | | Comparative Example | | | | | | | |
|---|---|---|---|---|---|---|---|---|---|---|
| | | | 1 | 2 | 3 | 4 | 5 | 6 | 7 | 8 |
| Auxiliary sensitizer | Hydrazine nitrate | | | | 2.0 | 2.2 | | 40.0 | | |
| | Monomethylamine nitrate | | | 4.0 | 1.0 | 4.0 | 5.0 | | 3.0 | |
| | Ethylenediamine nitrate | | | | | | | 5.0 | 3.0 | |
| | Ethanolamine nitrate | | | | | | 4.0 | | | |
| | Sodium chlorate | | | | | | | | | 4.0 |
| | Aluminum powder | | | | | | | | | 1.0 |
| Emulsion stability | Zinc stearate | | | 0.3 | 0.7 | 0.4 | | | | |
| Chelating agent | Tartaric acid | | | 0.1 | | | 1.5 | 2.0 | 0.05 | |
| | Ethylenediaminetetra-acetic acid sodium salt | | | | 0.05 | 0.1 | | | | |
| | Nitrilotriacetic acid | | | | | 0.1 | | | | |
| | Triethanolamine | | | | | | | | | |
| Antipyretic anti-inflammator | Sodium chloride | | | | | 0.8 | | | | |
| Test results | (a) | Apparent specific density (g/cc) | 1.12 | 1.10 | 1.07 | 1.12 | 1.09 | 1.10 | 1.10 | 1.09 |
| | (b) | ASIS cycle (number) | 5 | 4 | 4 | 10 | 9 | 11 | 12 | 12 |
| | (c) | ISLT (after 12 months, °C.) | −20 | −15 | −20 | −20 | −25 | −20 | −25 | −25 |
| | (d) | Hardness by penetration (mm) | 25 | 11 | 10 | 25 | 26 | 27 | 21 | 24 |

EXAMPLES 11–18

The procedure of Example 1 is repeated using the reciped compositions as described in the columns of Examples 11–18 in Table 4 below to obtain respective W/O type emulsion explosives. Each emulsion explosive is tested on the same items as in Example 1. The results are shown in Table 4 below.

COMPARATIVE EXAMPLES 9–15

The procedure of Example 1 is repeated using the reciped compositions as described in the columns of Comparative Examples 9–15 in Table 4 to obtain respective W/O type emulsion explosive. Each emulsion explosive is tested on the same items as in Example 1. The results are shown in Table 4.

In Table 4, the circled numbers represent the following carbonaceous fuels, and the same circled numbers with Table 3 represent the same ones with Table 3.

(19) 115° F. Paraffin: Paraffin wax, m.p. 46° C., content of isoparaffin 0%, produced by Nippon Seiro K.K.

(20) OX-WISSEN-8: Low molecular weight polyethylene, softening point 84° C., number average molecular weight 950 corresponding to carbon numbers of 67, density 0.94 g/cc, has a carboxylic group at a terminal end, produced by Nippon Seiro K.K.

In Table 4, the foam retainers are the same with those of Table 3.

TABLE 4(a)

(wt %)

| | | Example | | | | | | | |
|---|---|---|---|---|---|---|---|---|---|
| | | 11 | 12 | 13 | 14 | 15 | 16 | 17 | 18 |
| Aqueous solution of inorganic oxidate | Ammonium nitrate | 75.5 | 73.1 | 75.3 | 72.0 | | 47.1 | 67.0 | 71.0 |
| | Sodium nitrate | 5.0 | 5.6 | 5.2 | | 38.3 | 1.2 | 9.2 | 9.2 |
| | Calcium nitrate | | | | | 3.7 | | | |
| | Water | 12.2 | 11.2 | 9.5 | 12.0 | 3.0 | 12.0 | 9.1 | 9.1 |
| Carbonaceous fuel | (1) Diarene 30 | 2.0 | | | | | | 0.16 | |
| | (2) Hiwax 110 | | 1.2 | | | | | | 1.04 |
| | (3) Polywax 500 | | | 1.2 | | | | | 1.0 |
| | (4) Polywax 655 | | | | 1.9 | 0.3 | | | |
| | (5) Polywax 1000 | | | | | | 2.4 | | |
| | (6) Selesinwax 140 | 1.0 | | | | 1.2 | 0.6 | | 1.0 |
| | (7) Bee wax | | 2.0 | | | | | | |
| | (8) Carbana wax Prime Yellow | | | 2.2 | | | | | |
| | (9) Microwax 160 | | | | 1.0 | | | | |
| | (10) Waxrex 602 | | | | | | | | |
| | (11) Sazolewax HI | | | | | | | 3.04 | 0.16 |
| Emulsifier | Sorbitanmonooleate | 1.7 | 1.6 | 1.2 | 1.5 | | | 1.6 | |
| | Monoglyceride stearate | | | 0.5 | | 1.5 | 1.5 | | 1.6 |

TABLE 4(b)

(wt %)

| | | Example | | | | | | | |
|---|---|---|---|---|---|---|---|---|---|
| | | 11 | 12 | 13 | 14 | 15 | 16 | 17 | 18 |
| Foam retainer | (20) GMB (Q-cel #500) | 2.6 | | | 4.0 | 3.0 | | | |
| | (21) SMB (SPW-7) | | | | | 2.0 | 3.0 | 4.85 | |
| | (22) RMB (Exparcel DE) | | | | | | 0.2 | | |
| | (23) Foamed styrol | | 0.9 | 1.15 | | | | | 0.9 |
| Auxiliary sensitizer | Hydrazine nitrate | | | 2.0 | 2.2 | 40.0 | | | |
| | Monomethylamine nitrate | | 4.0 | 1.0 | 4.0 | | | 3.0 | |
| | Ethylenediamine nitrate | | | | | 5.0 | 29.0 | | |
| | Ethanolamine nitrate | | | | | | 1.0 | | |
| | Sodium chlorate | | | | | | | | 4.0 |
| | Aluminum powder | | | | | | | | 1.0 |
| Emulsion stability | Zinc stearate | | 0.3 | 0.7 | 0.4 | | | | |
| Chelating agent | Tartaric acid | | 0.1 | | | | | 0.05 | |
| | Ethylenediaminetetraacetic acid sodium salt | | | 0.05 | 0.1 | | 1.0 | | |
| | Nitrilotriacetic acid | | | | 0.1 | | 1.0 | | |
| Antipyretic anti-inflammator | Sodium chloride | | | | 0.8 | | | | |
| Test results | (a) Apparent specific density (g/cc) | 1.12 | 1.10 | 1.07 | 1.12 | 1.14 | 1.14 | 1.10 | 1.09 |
| | (b) ASIS cycle (number) | 9 | 11 | 14 | 11 | 10 | 14 | 9 | 12 |
| | (c) ISLT (after 12 months, °C.) | −20 | −25 | −25 | −25 | −20 | −15 | −20 | −20 |
| | (d) Hardness by penetration (mm) | 11 | 15 | 17 | 12 | 15 | 13 | 11 | 16 |

TABLE 4(c)

(wt %)

| | | Comparative Example | | | | | | |
|---|---|---|---|---|---|---|---|---|
| | | 9 | 10 | 11 | 12 | 13 | 14 | 15 |
| Aqueous solution of inorganic oxidate | Ammonium nitrate | 73.1 | 75.3 | 65.1 | | 69.0 | 71.0 | 75.5 |
| | Sodium nitrate | 5.6 | 5.2 | 4.2 | 38.7 | 9.2 | 9.2 | 5.0 |
| | Calcium nitrate | | | 1.0 | 3.7 | | | |
| | Water | 11.2 | 9.5 | 10.2 | 3.0 | 9.1 | 9.1 | 12.2 |
| Carbonaceous fuel | (14) Hiwax 2w00 | 2.0 | | | | | | |
| | (15) Polywax 2000 | | 2.4 | | | | 2.0 | |

TABLE 4(c)-continued

| | | Comparative Example | | | | | | (wt %) |
|---|---|---|---|---|---|---|---|---|
| | | 9 | 10 | 11 | 12 | 13 | 14 | 15 |
| | (24) OX-WEISSN-8 | | | | | | | 3.0 |
| | (16) Polybis 10N | | | | 0.5 | | | |
| | (17) Evaflex 210 | | | | 0.5 | | | |
| | (18) Ripolub 70 | | | | 0.5 | | | |
| | (6) Selesinwax 140 | 1.2 | | 2.813 | | | | |
| | (10) Waxrex 602 | | 1.0 | | | | | |
| | (19) 115° F. Paraffin | | | | | 1.2 | 1.2 | |
| | (3) Polywax 500 | | | 0.087 | | 2.0 | | |
| Emulsifier | Sorbitanmonooleate | 1.6 | 1.2 | 1.0 | | 1.6 | | 1.7 |
| | Monoglyceride stearate | | 0.5 | 0.3 | 1.5 | | 1.6 | |

TABLE 4(d)

| | | Comparative Example | | | | | | (wt %) |
|---|---|---|---|---|---|---|---|---|
| | | 9 | 10 | 11 | 12 | 13 | 14 | 15 |
| Foam retainer | (20) GMB (Q-cel #500) | | | 4.0 | 3.0 | | | 2.0 |
| | (21) SMB (SPW-7) | | | | 1.6 | 4.85 | | |
| | (22) RMB (Exparcel DE) | | | | | | | 0.6 |
| | (23) Foamed styrol | 0.9 | 1.15 | 0.3 | | | 0.9 | |
| Auxiliary sensitizer | Hydrazine nitrate | | 2.0 | | 40.0 | | | |
| | Monomethylamine nitrate | 4.0 | 1.0 | 5.0 | | 3.0 | | |
| | Ethylenediamine nitrate | | | | 5.0 | | | |
| | Ethanolamine nitrate | | | 4.0 | | | | |
| | Sodium chlorate | | | | | | 4.0 | |
| | Aluminum powder | | | | | | 1.0 | |
| Chelating agent | Tartaric acid | 0.1 | | 1.5 | 2.0 | 0.05 | | |
| | Ethylenediaminetetraacetic acid sodium salt | | 0.05 | | | | | |
| Test results | (a) Apparent specific density (g/cc) | 1.10 | 1.07 | 1.09 | 1.10 | 1.10 | 1.09 | |
| | (b) ASIS cycle (number) | 4 | 4 | 9 | 11 | 12 | 12 | unemul- |
| | (c) ISLT (after 12 months, °C.) | −15 | −25 | −25 | −20 | −25 | −25 | sifiable |
| | (d) Hardness by penetration (mm) | 11 | 10 | 26 | 27 | 21 | 24 | |

From the comparisons of the values of Examples 11–18 and the values of Comparative Examples 9–14 as shown in Table 4, it is seen clearly that the W/O type emulsion explosives of Examples 11–18 containing the specific low molecular weight polyethylenes and 95% or less of specific mineral, animal, vegetable, petroleum, or synthetic wax as the carbonaceous fuel are hard in property without damaging the aging stability, as compared with those not containing or using such specific carbonaceous fuel.

Although the present invention has been explained with specific examples and numerical values, it is of course apparent to those skilled in the art that various changes and modifications thereof are possible without departing the broad spirit and aspect of the present invention as defined in the appended claims.

What is claimed is:

1. A water in oil type emulsion explosive containing a continuous phase of a carbonaceous fuel, a dispersive phase of an aqueous solution of an inorganic oxidate, an emulsifier, and a foam retainer, wherein the carbonaceous fuel is a low molecular weight polyethylene of 20–80 carbon atoms not having a polar group at its terminal end, and having a melting point or softening point of 40°–120° C., a number average molecular weight of 350–1,000, and a density of 0.90–0.96.

2. A water in oil type emulsion explosive as defined in claim 1, wherein the inorganic oxidate is essentially composed of ammonium nitrate.

3. A water in oil type emulsion explosive as defined in claim 1, wherein the foam retainer is aggregates of foams.

4. A water in oil type emulsion explosive as defined in claim 1, wherein the foam retainer is micro hollow spheres and aggregates of foams.

5. A water in oil type emulsion explosive, wherein the amount of the carbonaceous fuel is 1–10 wt %, the amount of the inorganic oxidate consisting essentially of ammonium nitrate is 36–95 wt %, the amount of the emulsifier is 0.1–7 wt %, and the amount of the foam retainer is such that can adjust the apparent specific density of the emulsion explosive to 0.8–1.35.

6. A water in oil type emulsion explosive as defined in claim 1, which contains further an auxiliary sensitizer selected from the group consisting of water soluble nitrates of amine, water soluble nitrates of alkanol amine, and aluminum powder.

7. A water in oil type emulsion explosive as defined in claim 1, which further contains hydrazine nitrate optionally with a chelating agent.

8. A water in oil type emulsion explosive as defined in claim 1, which has a hardness of penetration depth of 10–20 mm.

9. A water in oil type emulsion explosive containing a continuous phase of a carbonaceous fuel, a dispersive phase of an aqueous solution of an inorganic oxidate, an emulsifier, and a foam retainer, wherein the carbonaceous fuel is composed of 5 wt % or more of a low molecular weight polyethylene of 20–80 carbon atoms not having a polar group at its terminal end, and having a melting point or softening point of 40°–120° C., a number average molecular weight of 350–1,000, and a density of 0.90–0.96 cc/g, and 95 wt % or less of at least one or two waxes selected from the group consisting of mineral, animal, vegetable, petroleum and synthetic waxes of a melting point of 40° C. or more and containing 10 wt % or more of isoparaffin.

10. A water in oil type emulsion explosive as defined in claim 1, wherein the inorganic oxidate is essentially composed of ammonium nitrate.

11. A water in oil type emulsion explosive as defined in claim 1, wherein the foam retainer is aggregate of foams.

12. A water in oil type emulsion explosive as defined in claim 1, wherein the foam retainer is micro hollow spheres and aggregates of foams.

13. A water in oil type emulsion explosive as defined in claim 9, wherein the amount of the carbonaceous fuel is 1–10 wt %, the amount of the inorganic oxidate consisting essentially of ammonium nitrate is 36–95 wt %, the amount of the emulsifier is 0.1–7 wt %, and the amount of the foam retainer is such that can adjust the apparent specific density of the emulsion explosive to 0.8–1.35.

14. A water in oil type emulsion explosive as defined in claim 9, which contains further an auxiliary sensitizer selected from the group consisting of water soluble nitrates of amine, water soluble nitrates of alkanol amine, and aluminum powder.

15. A water in oil type emulsion explosive as defined in claim 9, which further contains hydrazine nitrate optionally with a chelating agent.

16. A water in oil type emulsion explosive as defined in claim 9, which has a hardness of penetration depth of 10–20 mm.

* * * * *